US005746947A

United States Patent [19]

Vanderpool et al.

[11] Patent Number: 5,746,947

[45] Date of Patent: May 5, 1998

[54] ALKYLBENZOTRIAZOLE COMPOSITIONS AND THE USE THEREOF AS COPPER AND COPPER ALLOY CORROSION INHIBITORS

[75] Inventors: Daniel P. Vanderpool, Coraopolis; Charles Y. Cha, McMurray, both of Pa.

[73] Assignee: Calgon Corporation, Pittsburgh, Pa.

[21] Appl. No.: 540,977

[22] Filed: Jun. 20, 1990

[51] Int. Cl.[6] ..... C23F 11/14; C23F 11/10

[52] U.S. Cl. ..... 252/394; 252/395; 252/389.61; 422/16

[58] Field of Search ..... 422/16; 252/395, 252/394, 389.61

[56] References Cited

U.S. PATENT DOCUMENTS

| | | | |
|---|---|---|---|
| 2,861,078 | 11/1958 | Schlaudecker | 548/257 |
| 2,941,953 | 6/1960 | Hatch | 422/16 X |
| 3,342,749 | 9/1967 | Handleman | 252/395 X |
| 3,413,227 | 11/1968 | Howard | 252/51.5 R |
| 3,803,049 | 4/1974 | Korpics | 252/390 |
| 3,887,481 | 6/1975 | Korpics | 252/394 X |
| 3,985,503 | 10/1976 | O'Neal, Jr. | 422/7 |
| 4,060,491 | 11/1977 | Bridger et al. | 508/280 |
| 4,128,065 | 12/1978 | Hollander | 110/211 |
| 4,149,969 | 4/1979 | Robitaille et al. | 422/16 |
| 4,184,991 | 1/1980 | Scheurman, III | 524/91 |
| 4,188,212 | 2/1980 | Fujiwara et al. | 430/69 |
| 4,202,796 | 5/1980 | Jacob et al. | 422/16 |
| 4,219,433 | 8/1980 | Manabe et al. | 422/16 |
| 4,255,395 | 3/1981 | Gallacher et al. | 423/24 |
| 4,338,209 | 7/1982 | Manabe et al. | 252/391 X |
| 4,363,913 | 12/1982 | Clark et al. | 548/164 |
| 4,406,811 | 9/1983 | Christensen | 422/16 X |
| 4,613,481 | 9/1986 | Gill et al. | 422/16 |
| 4,657,785 | 4/1987 | Kelly et al. | 422/16 |
| 4,668,474 | 5/1987 | Gill et al. | 422/16 |
| 4,675,158 | 6/1987 | Klindera | 252/16 |
| 4,686,059 | 8/1987 | Payerele | 422/16 |
| 4,728,452 | 3/1988 | Hansen | 422/16 |
| 4,744,950 | 5/1988 | Hollander | 422/16 |
| 4,873,139 | 10/1989 | Kinosky | 428/341 |
| 5,441,563 | 8/1995 | Sideman et al. | 524/94 |

FOREIGN PATENT DOCUMENTS

| | | |
|---|---|---|
| 173427 | 6/1984 | European Pat. Off. . |
| 0173427A2 | 3/1986 | European Pat. Off. . |
| 0462809B1 | 12/1991 | European Pat. Off. . |
| 2330340 | 1/1974 | Germany . |
| 55-0008465 | 1/1980 | Japan . |
| 56-0142873 | 11/1981 | Japan . |
| 57-26175 | 2/1982 | Japan . |
| 57-0152476 | 9/1982 | Japan . |
| 1065995 | 4/1967 | United Kingdom . |
| 1198312 | 7/1970 | United Kingdom . |
| 1347008 | 2/1974 | United Kingdom . |

OTHER PUBLICATIONS

CA 95(6):47253 Oct. 1979.
CA 102:153153b Dec. 1984.

*Primary Examiner*—Sharon Gibson
*Assistant Examiner*—Valerie Fee
*Attorney, Agent, or Firm*—W. C. Mitchell; Mark A. Montgomery

[57] ABSTRACT

An alkylbenzotriazole, in combination with mercaptobenzotriazole, tolyltriazole, benzotriazole and/or 1-phenyl-5-mercaptotetrazole, is used to inhibit the corrosion of metallic surfaces, particularly copper surfaces, in contact with an aqueous system. Systems and compositions are also claimed.

18 Claims, No Drawings

ALKYLBENZOTRIAZOLE COMPOSITIONS AND THE USE THEREOF AS COPPER AND COPPER ALLOY CORROSION INHIBITORS

BACKGROUND OF THE INVENTION

Benzotriazole, mercaptobenzothiazole and tolyltriazole are well known copper corrosion inhibitors. For example, see U.S. Pat. No. 4,675,158 and the references cited therein. This patent discloses the use of tolyltriazole/mercaptobenzothiazole compositions as copper corrosion inhibitors. Also, see U.S. Pat. No. 4,744,950, which discloses the use of lower ($C_3$–$C_6$) alkylbenzotriazoles as corrosion inhibitors, and corresponding EPO application No. 85304467.5.

U.S. Pat. No. 4,338,209 discloses metal corrosion inhibitors which contain one or more of mercapto-benzothiazole, tolyltriazole and benzotriazole. Examples of formulations containing benzotriazole and tolyltriazole and formulations containing mercaptobenzothiazole and benzotriazole are given.

Copending patent application U.S. Ser. No. 348,521 relates to the use of higher alkylbenzotriazoles as copper and copper alloy corrosion inhibitors, and copending patent application U.S. Ser. No. 348,532 relates to the use of alkoxybenzotriazoles as copper and copper alloy corrosion inhibitors.

U.S. Pat. No. 4,406,811 discloses compositions containing a triazole such as tolyltriazole, benzotriazole or mercaptobenzothiazole, an aliphatic mono- or di-carboxylic acid and a nonionic wetting agent.

U.S. Pat. No. 4,363,913 discloses a process for preparing 2-aminobenzothiazoles and alkyl and alkoxy-substituted aminobenzothiazoles.

U.S. Pat. No. 2,861,078 discloses a process for preparing alkyl and alkoxy-substituted benzotriazoles.

U.S. Pat. No. 4,873,139 discloses the use of 1-phenyl-IH-tetrazole-5-thiol to prepare corrosion-resistant silver and copper surfaces. The use of 1-phenyl-5-mercaptotetrazole to inhibit the corrosion of carbon steel in nitric acid solutions is also known. See Chemical Abstract CA 95(6):47253 mm (1979).

The present invention relates to alkylbenzotriazole compositions comprising a) a $C_3$–$C_{12}$ alkylbenzo-triazole; and b) a compound selected from the group consisting of mercaptobenzothiazole, tolyltriazole, benzotriazole, and 1-phenyl-5-mercaptotetrazole, and salts thereof and the use thereof as corrosion inhibitors, particularly copper and copper alloy corrosion inhibitors. These compositions form long-lasting protective films on metallic surfaces, particularly copper and copper alloy surfaces, in contact with aqueous systems, and are especially effective in high-solids water. Additionally, these compositions generally provide improved tolerance to oxidizing biocides such as chlorine and bromine.

The use of the instant blends of $C_3$ to $C_{12}$ alkylbenzotriazoles and one or more of mercapto-benzothiazole, tolyltriazole, benzotriazole and 1-phenyl-5-mercaptotetrazole overcomes the slow passivation by the alkylbenzotriazoles alone, allows the use of lower concentrations of expensive alkylbenzotriazoles for effective durable (persistent) film formation, and overcomes the problem of failure to obtain passivation by alkylbenzotriazoles alone in high-solids waters. As used herein the term "passivation" refers to the formation of a film which lowers the corrosion rate of the metallic surface which is being treated.

"Passivation rate" refers to the time required to form a protective film on a metallic surface, and "persistency" refers to the length of time a protective film is present on a metallic surface when a corrosion inhibitor is not present in an aqueous system which is in contact with the coated metallic surface. Also, the term "high solids water" refers to water which contains dissolved solids in excess of about 1,500 mg/L. Dissolved solids include, but are not limited to, anions released from chlorides, sulfates, silicates, carbonates, bicarbonates and bromides; and cations such as lithium, sodium, potassium, calcium and magnesium.

The instant alkylbenzotriazole/tolyltriazole, benzotriazole, mercaptobenzothiazole and/or phenyl mercaptotetrazole compositions are not known or suggested in the art.

DESCRIPTION OF THE INVENTION

In its broadest sense, the instant invention is directed to compositions which comprise a) a $C_3$–$C_{12}$ alkyl benzotriazole or salt thereof and b) a compound selected from the group consisting of tolyltriazole and salts thereof, benzotriazole and salts thereof, mercaptobenzothiazole and salts thereof and phenyl mercaptotetrazole and its isomers and salts thereof. More particularly, the instant invention is directed to compositions comprising: a) a $C_3$–$C_{12}$ alkylbenzo-triazole or salt thereof and b) a compound selected from the group consisting of mercaptobenzothiazole, tolyltriazole, benzotriazole, 1-phenyl-5-mercaptotetrazole, isomers of phenyl mercaptotetrazole and salts thereof, wherein the weight ratio of a):b), on an active basis, ranges from about 0.01:100 to about 100:1, preferably about 0.1:20 to about 20:1 and most preferably from about 0.1:10 to about 10:1. The instant invention is also directed to a method for inhibiting the corrosion of metallic surfaces, particularly copper and copper alloy surfaces, in contact with an aqueous system, comprising adding to the aqueous system being treated an effective amount of at least one of the above described compositions.

The instant invention is also directed to an aqueous system which is in contact with a metallic surface, particularly a copper or copper alloy surface, which contains an effective amount of at least one of the instant compositions.

Compositions comprising water, particularly cooling water, and the instant alkylbenzotriazole compositions are also claimed.

The inventors have discovered that the instant alkylbenzotriazole compositions are effective corrosion inhibitors, particularly with respect to copper and copper-containing metals. These compositions form durable, long-lasting (persistent) films on metallic surfaces, including but not limited to copper and copper alloy surfaces. Since the alkylbenzotriazole compositions of this invention are especially effective inhibitors of copper and copper alloy corrosion, they can be used to protect multimetal systems, especially those containing copper or a copper alloy and one or more other metals.

The instant inventors have also discovered a surprising and beneficial interaction between 5-($C_3$ to $C_{12}$ alkyl) benzotriazoles and one or more of mercaptobenzothiazole, tolyltriazole, benzotriazole and 1-phenyl-5-mercaptotetrazole and salts thereof. Aside from the fact that such compositions provide cost effective corrosion control in cooling water systems, these blends provide faster passivation rates than alkylbenzotriazoles alone or other azoles alone and are particularly effective when used to provide passivation in high-solids, aggressive water in which expensive alkylbenzotriazoles alone fail to passivate copper. Also, the instant compositions cause the formation of durable protective films, which have improved resistance to chlorine-induced corrosion, while lowering the cost of utilizing alkylbenzotriazoles alone as corrosion inhibitors.

Further, the use of the instant admixtures allows for intermittent feed to the cooling system being treated, which provides benefits relative to ease of monitoring and environmental impact, while lowering the average inhibitor requirement.

The faster rate of passivation also allows operators more flexibility in providing the contact required to form a durable film, and the ability to passivate in high-solids, particularly high dissolved solids, waters extends the range of water qualities in which alkylbenzotriazole inhibitors can be used.

The instant inventors have also found that the instant alkylbenzotriazole compositions de-activate soluble copper ions, which prevents the galvanic deposition of copper which concomminantly occurs with the galvanic dissolution of iron or aluminum in the presence of copper ions. This reduces aluminum and iron corrosion. These compositions also indirectly limit the above galvanic reaction by preventing the formation of soluble copper ions due to the corrosion of copper and copper alloys.

Any alkylbenzotriazole compound having the following structure can be used:

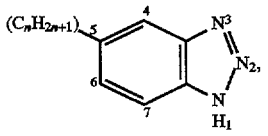

wherein n is greater than or equal to 3 and less than or equal to 12. Salts of such compounds may also be used.

Isomers of the above described alkylbenzotriazoles can also be used as component a). The 5 and 6 isomers are interchangeable by a simple prototropic shift of the 1 position hydrogen to the 3 position and are believed to be functionally equivalent. The 4 and 7 isomers are believed to function as well as or better than the 5 or 6 isomers, though they are generally more difficult and expensive to manufacture. As used herein, the term "alkylbenzotriazoles" is intended to mean 5-alkyl benzotriazoles and 4,6 and 7 position isomers thereof, wherein the alkyl chain length is greater than or equal to 3 but less than or equal to 12 carbons, branched or straight, preferably straight. Compositions containing straight chain alkylbenzotriazoles are believed to provide more persistent films in the presence of chlorine.

Component b) of the instant compositions is a compound selected from the group consisting of mercaptobenzothiazole (MBT) and salts thereof, preferable sodium and potassium salts of MBT, tolyltriazole (TT) and salts thereof, preferably sodium and potassium salts of TT, benzotriazole (BT) and salts thereof, preferably sodium and potassium salts thereof, 1-phenyl-5-mercaptotetrazole (PMT), isomers of PMT, including tautomeric isomers such as 1-phenyl-5 tetrazolinthione and positional isomers such as 2-phenyl-5-mercaptotetrazole and its tautomers, substituted phenyl mercaptotetrazoles, wherein phenyl is $C_1$–$C_{12}$ (straight or branched) alkyl-, $C_1$–$C_{12}$ (straight or branched) alkoxy-, nitro-, halide-, sulfonamido- or carboxyamido-substituted, and salts of the above mercaptotetrazoles, preferably the sodium salt. TT and MBT or salts thereof are preferred, and TT is most preferred. The ratio, by weight, of component a):b) should range from about 0.01:100 to about 100:1, preferably from about 0.1:20 to about 20:1, and most preferably from about 0.1:10 to about 10:1.

An effective amount of the instant alkylbenzo-triazole composition should be used. As used herein, the term "effective amount" relative to the instant compositions refers to that amount of an instant composition, on an active basis, which effectively inhibits metal corrosion in a given aqueous system. Preferably, the instant compositions are added at an active concentration of at least 0.1 ppm, more preferably about 0.1 to about 500 ppm, and most preferably about 0.5 to about 100 ppm, based on the total weight of the water in the aqueous system being treated.

Maximum concentrations of the instant compositions are determined by the economic considerations of the particular application. The maximum economic concentration will generally be determined by the cost of alternative treatments of comparable effectivenesses, assuming that such comparable treatments are available. Cost factors include, but are not limited to, the total through-put of system being treated, the costs of treating or disposing of the discharge, inventory costs, feed-equipment costs, and monitoring costs. On the other hand, minimum concentrations are determined by operating conditions such as pH, dissolved solids and temperature.

Further, compositions comprising a copper corrosion inhibiting compound selected from the group consisting of tolyltriazole, benzotriazole, phenyl mercapto-tetrazoles, substituted phenyl mercaptotetrazoles, mercaptobenzothiazole, and salts thereof and an effective amount of an alkyl benzotriazole, preferably at least about 0.001 part alkylbenzotriazole per part of said copper corrosion inhibiting compound, can be used. The instant inventors have discovered that the performance of corrosion inhibiting compounds such as TT, BT, MBT, PMT, phenyl-substituted PMT and salts thereof is greatly enhanced by the presence of very small quantities of alkylbenzotriazoles. Thus, an effective amount (for the purpose of improving the film persistence, the passivation rate, the high dissolved solids performance and/or the overall effectiveness of an inhibitor such as TT) of an alkylbenzotriazole such as butylbenzotriazole greatly improves the efficacy of conventional copper corrosion inhibitors. While virtually any amount of an alkylbenzotriazole helps, the preferred amount is at least about 0.001 part alkyl benzotriazole per part corrosion inhibition. More preferably, the weight ratio of alkylbenzotriazole: corrosion inhibitor ranges from about 0.001 to about 100.

The alkylbenzotriazoles of the instant invention may be prepared by any known method. For example, the instant alkylbenzotriazoles may be prepared by contacting a 4-alkyl-1, 2-diaminobenzene with an aqueous solution of sodium nitrite in the presence of an acid, e.g., sulfuric acid, and then separating the resultant oily product from the aqueous solution. The 4-alkyl-1,2-diaminobenzene may be obtained from any number of sources. Also, see U.S. Pat. No. 2,861,078, which discusses the synthesis of alkylbenzotriazoles. Butyl benzotriazole is commercially available from Betz Laboratories, Trevose, Pa.

The compounds used as component (b) are all commercially available. For example, tolyltriazole and benzotriazole are commercially available from PMC, Inc. MBT is commercially available from 1) Uniroyal Chemical Co., Inc. or 2) Monsanto, and PMT is commercially available from 1) Fairmount Chemical Co., Inc., 2) Aceto Corporation and 3) Triple Crown America, Inc. Generally, TT and MBT are sold as sodium salts.

The instant compositions may be prepared by simply blending the constituent compounds. Suitable preparation techniques are well known in the art of water treatment and by suppliers of triazoles. For example, aqueous solutions may be made by blending the solid ingredients into water containing an alkali salt like sodium hydroxide or potassium hydroxide; solid mixtures may be made by blending the powders by standard means; and organic solutions may be made by dissolving the solid inhibitors in appropriate organic solvents. Alcohols, glycols, ketones and aromatics, among others, represent classes of appropriate solvents.

The instant method may be practiced by adding the constituent compounds simultaneously (as a single composition), or by adding them separately, whichever is more convenient. Suitable methods of addition are well known in the art of water treatment.

The instant compositions can be used as water treatment additives for industrial cooling water systems, gas scrubber systems or any water system which is in contact with a metallic surface, particularly surfaces containing copper and/or copper alloys. They can be fed alone or as part of a treatment package which includes, but is not limited to, biocides, scale inhibitors, dispersants, defoamers and other corrosion inhibitors. Also, the instant alkylbenzotriazole compositions can be fed intermittently or continuously.

Treatment of cooling water which contacts copper or copper alloy surfaces, such as admiralty brass or 90/10 copper-nickel requires the use of specific copper inhibitors. These inhibitors:

1. minimize the corrosion of the copper or copper alloy surfaces, including general corrosion, dealloying and galvanic corrosion; and
2. minimize problems of galvanic "plating-out" of soluble copper ions onto iron or aluminum. Thus, soluble copper ions can enhance the corrosion of iron and/or aluminum components in contact with aqueous systems. This occurs through the reduction of copper ions by iron or aluminum metal, which is concommitantly oxidized, resulting in the "plating-out" of copper metal onto the iron surface. This chemical reaction not only destroys the iron or aluminum protective film but creates local galvanic cells which can cause pitting corrosion of iron or aluminum.

While conventional copper inhibitors such as tolyltriazole, benzotriazole, and mercapto-benzothiazole, which are used in the instant compositions, are commonly used alone as copper inhibitors in aqueous systems, they are generally fed continuously because of the limited durability of their protective films.

The requirement for continuous feed generally makes it uneconomical to apply these conventional inhibitors to once-through systems or systems with high blowdown rates. Additionally, conventional inhibitors provide only limited protection against chlorine induced corrosion.

While 5-(lower alkyl)benzotriazoles are known which do not require continuous feeding in order to inhibit copper corrosion (see U.S. Pat. No. 4,744,950), these compounds provide relatively poor performance in the presence of chlorine, and may be ineffective in high-solids waters.

These deficiencies are generally overcome by the instant compositions. It is therefore an object of the instant invention to provide inhibitors which produce more chlorine resistant protective films, and which are effective in high-solids, particularly high dissolved solids, aggressive waters.

These objects are achieved through the use of the instant alkylbenzotriazole/TT,BT,MBT or PMT compositions, which quickly provide protective, durable films on metallic surfaces, especially copper and copper alloy surfaces. These compositions are especially effective in the presence of oxidizing biocides such as chlorine and bromine biocides and/or high solids.

Further, the instant compositions allow the use of an intermittent feed to cooling water systems. Depending on water aggressiveness, the time between feedings may range from several days to months. This results in an average lower inhibitor requirement and provides advantages relative to waste treatment and environmental impact.

EXAMPLES

The following examples demonstrate the effectiveness of the instant compounds as copper and copper alloy corrosion inhibitors. They are not, however, intended to limit the scope of the invention in any way.

Example 1

Butylbenzotriazole Alone, High Dissolved Solids Water

This example illustrates the failure of butylbenzotriazole, alone, to form a protective film on (passivate) copper in high dissolved solids waters.

The test cell used consisted of an 8-liter vessel fitted with a stirrer, an air dispersion tube, a heater-temperature regulator, and a pH control device. The temperature was regulated at 50±2° C. The pH was automatically controlled by the addition of 1% sulfuric acid or 1% sodium hydroxide solutions to maintain the desired pH. Air was continually sparged into the cell to maintain air saturation. Water lost by evaporation was replenished by deionized water as needed.

The composition of the water used in Example 1 is shown in Table I. This water is representative of the brackish water oftentimes used for cooling water purposes at utilities. Hydroxyethylidenediphosphonic acid (HEDP) was added at a dosage of 0.5 mg/L, on an active basis, to the water to prevent calcium carbonate precipitation during the test.

TABLE I

| Water Composition | |
|---|---|
| $Ca^{+2}$ | 750 mg/L |
| $Mg^{+2}$ | 130 mg/L |
| $Na^{+2}$ | 2166 mg/L |
| $Cl^{-}$ | 2400 mg/L |
| $SO_4^{-2}$ | 3200 mg/L |
| $HCO_3^{-2}$ | 198 mg/L @ pH 8 |
| | 45 mg/L @ pH 7 |
| HEDP | 0.5 mg/L (Added to prevent calcium carbonate precipitation) |

Corrosion rates were determined by: 1) weight loss measurements using 1"×2" copper coupons after immersion for one (1) week using the standard procedures described in ASTM Method (G1-81) and, 2) by electrochemical linear polarization according to the procedures of Petrolite Corp.'s PAIR® technique with copper probes.

The PAIR® (Polarization Admittance Instantaneous Rate) technique measures instantaneous corrosion rates while the weight loss method measures the cumulative weight loss for the duration of the test. Therefore, exact agreement between the two measurements is not expected. However, if desired, the electrochemically determined corrosion rates may be mathematically averaged in order to give numbers suitable for comparison with the weight loss numbers.

The inhibitor concentration is stated in terms of mg/L of its sodium salt.

The corrosion rates for copper coupons immersed in the above-defined water at pH 7.0 and 50° C. containing various concentrations of the sodium salt of butylbenzotriazole (BBT) are shown in Table II. It is obvious that BBT was ineffective in this water as a copper inhibitor. By contrast, the sodium salt of tolyltriazole provided excellent protection at a concentration of 2 mg/L.

TABLE II

Corrosion Rate of Copper in High-Solids Water at pH 7.0, 50° C.

| Inh. | Inhibitor Conc (mg/L) | Instantaneous Corrosion Rate By PAIR Probe (mpy) 1 Hr. | 48 Hr. | 1 Week | Cumulative Corrosion Rate By Weight Loss (mpy) 1 Week Duration |
|---|---|---|---|---|---|
| None | 0 | 4 | 2.3 | 2.3 | 3.0 |
| BBT[1] | ½ | 12 | 4.5 | 2.7 | 2.7 |
| BBT | 1.0 | 11 | 4.5 | 2.0 | 3.1 |
| BBT | 3.0 | 10 | 5.0 | 4.0 | 5.2 |
| BBT | 5.0 | 3 | 0.7 | 0.8 | 2.9 |
| BBT | 10.0 | 11 | — | — | 3.6 |
| TT[2] | 2.0 | 0.1 | 0.05 | 0.05 | 0.1 |

[1]BBT is the sodium salt of butylbenzotriazole.
[2]TT is tolyltriazole sodium salt.

Example 2

BBT COMPOSITIONS

This example shows the benefits in terms of corrosion rates of utilizing admixtures of various copper corrosion inhibitors and BBT in the water of Example 1. Results are shown in Table III.

TABLE III

Comparison of Effectiveness of BBT And Admixtures of BBT and TT, PMT or MBT[1] For Copper Corrosion Control in the Water of Exanple 1 at pH 7, 50° C. Corrosion Rates by PAIR® Technique, (mpy)

| Passivation Time | 2 mg/L TT Alone | 1 mg/L BBT Alone | 1 mg/L BBT Plus 1 mg/L TT | 1 mg/L BBT Plus 1 mg/L PMT | 1 mg/L BBT Plus 1 mg/L MBT |
|---|---|---|---|---|---|
| ¼ Hr. | 0.4 | See Example 1 | 0.4 | 10 | 16 |
| 1 Hr. | 0.1 | Failed to | 0.1 | 7 | 16 |
| 18 Hr. | 0.05 | Passivate | 0.05 | .15 | 4.5 |
| 44 Hr. | 0.05 | | 0.05 | 0.1 | 1.4 |
| Persistance: Change Probes to Inhibitor Free Water | | | | | |
| 0 Hr. | 0.05 | | 0.06 | Not Determined | Not Determined |
| 1 Hr. | 5 | | | | |
| 48 Hr. | | | 0.06 | | |
| 480 Hr. | | | 0.08 | | |
| 790 Hr. | | | 0.01 | | |

[1]BBT is the sodium salt of butylbenzatriazole, TT is the sodium salt of tolyltriazole, PMT is the sodium salt of phenyl merceptotetrazole and MBT is the sodium salt of mercaptobenzothiazole.

In this test, passivation rates were determined electrochemically by measuring the decrease in corrosion rate as the time of immersion increased. After the designated times, and after protective films were formed, the probes were removed from the original water which contained the inhibitor, and placed in inhibitor free water (i.e., the water of Example 1). Film persistency was measured as the time required for the corrosion rate to increase, which indicates deterioration of the protective film. For example, although tolyltriazole passivates the copper probes rapidly and efficiently, the protective film is not persistent in the absence of free inhibitor in solution, since the film begins to deteriorate immediately in inhibitor-free water.

By contrast, at pH 7, 50° C., a mixture of 1 mg/L of BBT and 1 mg/L tolyltriazole not only passivated i.e., formed a protective film, the copper probes at an acceptable rate (in contrast to the failure of 2 mg/L of BBT to passivate the probes), but the persistency of the film formed by the BBT/tolyltriazole mixture was great. This is shown by the fact that the film persisted for in excess of about 790 hours, while that for TT alone persisted less than 1 hr.

These two benefits, namely, improved passivation and improved film persistence, indicate that BBT and tolyltriazole are both involved in the formation of the protective film, giving excellent overall protection.

Example 3

BBT at pH 8

This example illustrates the poor passivation of BBT (sodium salt of butylbenzotriazole) at pH 8 in the water of Example 1.

The experimental setup was the same as described in Example 1, except that the pH was maintained at 8. The corrosion rates of this example were determined by the PAIR® technique. Results are shown in Table IV.

TABLE IV

Passivation Rate of Copper Using 2 mg/L of BBT at pH 8, 50° C.

| Passivation Time | Corrosion Rate By PAIR Tech. (mpy) | Control (No Inhibitor) |
|---|---|---|
| ¼ Hr. | 1.5 | 3–4 mpy |
| 18 Hr. | 0.3 | 2.5 mpy |
| 44 Hr. | 0.2 | 3.0 mpy |
| 120 Hr. | 0.15 | |
| Persistence (Change to Inhibitor Free Water) | | |

TABLE IV-continued

| Passivation Rate of Copper Using 2 mg/L of BBT at pH 8, 50° C. | | |
|---|---|---|
| Passivation Time | Corrosion Rate By PAIR Tech. (mpy) | Control (No Inhibitor) |
| 1 Hr. | 0.15 | |
| 94 Hr. | 0.28 | |
| 171 Hr. | 0.37 | |
| 194 Hr. | 0.42 | |

Table IV, shows that 2 mg/L of BBT was insufficient to passivate the copper probes, even after five days (120 hrs.). Moreover, the corrosion rate began to increase when the probes were exposed to inhibitor-free water. The corrosion rate increased three-fold after only eight days.

Example 4

BBT Compositions at pH 8

This example illustrates the surprising improvement in performance provided by admixtures of BBT and other inhibitors in the water of Example 1 at pH 8, 50° C. Both the rate of passivation is improved and the film persistency is improved. This example also demonstrates that ultra low concentrations of BBT can be utilized when it is mixed with a second copper corrosion inhibitor.

The experimental setup was the same as Example 3. Results are shown in Table V.

Comparison of the results for the individual components (see Example 3 and the last two columns of Table V) with the results for the admixtures (see columns 1, 2, and 3 of Table V) demonstrates the surprising enhancement in performance by combining an alkylbenzotriazole with a conventional inhibitor.

It is noteworthy that, in comparing the results of Examples 3 and 4, the probes were allowed to contact the inhibitor for five days in Example 3, while in Example 4 only one day was allowed for passivation.

TABLE V

| Rates of Passivation and Film Persistency For Admixtures of BBT and TT, MBT, or PMT pH 8, 50° C. | | | | | |
|---|---|---|---|---|---|
| | Corrosion Rates in Example 1 Water, pH 8, 50° C. By PAIR Tech. (mpy) | | | | |
| Passivation Time | 1 mg/L BBT Plus 1 mg/L MBT | 1 mg/L BBT Plus 1 mg/L PMT | 0.05 mg/L BBT Plus 1 mg/L PMT | 1 mg/L PMT | 1 mg/L MBT |
| ¼ Hr. | 20 | 0.12 | 0.14 | 1.2 | 20 |
| 1 Hr. | 8 | 0.06 | 0.06 | 0.8 | 18 |
| 17 Hr. | 0.12 | 0.01 | 0.02 | 0.3 | 2 |
| 24 Hr. | 0.08 | 0.01 | 0.02 | 0.2 | 4 |
| Persistency (Change to Inhibitor Free Water) | | | | | |
| 0 | 0.08 | 0.01 | 0.02 | 0.2 | 1 |
| 3 Day | 0.04 | 0.01 | 0.03 | 0.3 | 3 |
| 20 Day | 0.04 | 0.06 | 0.05 | ** | ** |
| 30 Day | 0.04 | * | ** | | |

*Not Determined Due to pH Excursion
**Terminated Arbitrarily

Example 5

BBT and MBT

This example illustrates the improved performance of admixtures of BBT and MBT in relatively low dissolved solids water at pH 7. The PAIR techniques described in Example 1 was used to determine corrosion rates. It also shows that ultra low concentrations of BBT with MBT gave much faster passivation, longer film persistence, and more complete protection than either BBT or MBT alone. Thus, a mixture of 0.05 mg/L BBT and 0.5 ppm MBT gave more complete protection and faster passivation than 5 mg/L of BBT alone.

The composition of the low dissolved solids water is shown in Table VI. The results are shown in Table VII.

TABLE VI

| Composition of Low Dissolved Solids Water of Example 5 | |
|---|---|
| $Ca^{+2}$ | 108 mg/L |
| $Mg^{+2}$ | 28 mg/L |
| $Na^{+}$ | 112 mg/L |
| $Cl^{-}$ | 97 mg/L |
| $SO_4^{-2}$ | 196 mg/L |
| $SiO_2$ | 24 mg/L |

TABLE VII

Passivation and Persistency of Protective Films Formed by BBT and MBT in Low Dissolved Solids Water at pH 7, 50° C.

| Passivation Time | Corrosion Rate by PAIR[R] Probe Technique (mpy) | | | | |
|---|---|---|---|---|---|
| | BBT (5 mg/L) | BBT (0.05 mg/L) | BBT (0.05 mg/L) Plus MBT (0.5 mg/L) | MBT (5 mg/L) | Control No Inhibitor |
| 0 Hr. | — | 4.5 | 1.0 | — | |
| ⅓ Hr. | — | 2.5 | 0.01 | 0.05 | |
| 1 ⅓ Hr. | 0.07 | 1.2 | — | 0.01 | |
| 2 ⅓ Hr. | — | 0.8 | — | — | |
| 6 Hr. | 0.02 | 0.5 | — | — | |
| 25 Hr. | 0.02 | 0.1 | 0.01 | 0.005 | |
| 48 Hr. | — | 0.08 | — | — | 0.9 |
| Persistency (Change to inhibitor free water after 25 Hr. except 0.05 mg/L BBT which was allowed to remain in contact with inhibitor for 48 Hr.) | | | | | |
| 0 Hr. | 0.02 | 0.06 | <0.01 | | |
| 24 Hr. | 0.02 | 0.04 | <0.01 | <0.01 | 0.9 |
| 20 Day | 0.02 | 0.02 | <0.01 | 1.5 | 1.5 |

Example 6

Admixture Heptylbenzotriazole, Sodium Salt (HBT) and Tolyltriazole(TT)

The equipment used in this example consisted of an 8L reservoir, a heater/circulator and a coil heater to provide the desired heat flux. The coil heater was designed to fit securely around a ⅜" OD tube, which was then installed. Flow through the tube was monitored by an in-line rotameter which could accommodate liquid flows to 4000 ml/min. The power input to the heater was controlled by a rheostat, which made it possible to obtain various temperature differences across the tube. The tube inlet and outlet temperatures were monitored by thermocouples attached to a digital readout with accuracy of 0.1° F. The system was entirely closed to minimize evaporation. The linear velocity through the heated tube was approximately 2.2 fps. This yielded a Reynolds number of about 9350. Heat fluxes of 8,000–10,000 Btu/hr-ft$^2$ were chosen as typical for industrial practices.

The corrosion rates of heated Admiralty metal tubes were determined by the weight loss method as described in "Standard Practice for Preparing, Cleaning and Evaluating Corrosion Test Specimens" ASTM designation G1-81. Admiralty metal has the following composition:

Cu—72%, by weight

Sn—0.9%, by weight

Pb—less than 0.05%, by weight

Fe—0.04%, by weight

As—0.05%, by weight

Zn—balance.

The Admiralty tube specimens were treated as follows:

1. Cleaned specimens were placed in the test unit to which a specified amount of inhibitor was added in order to achieve the desired inhibitor concentration.

The specimens were allowed to remain in contact with the inhibited solution (i.e., passivate) for 24 hours at which time they were placed in inhibitor-free water.
2. Chlorine was then added so that an initial concentration of 1 mg/L free chlorine was obtained. The chlorine concentration normally decreased from 1 mg/L to 0.7 mg/L during the one hour exposure time.
3. After one hour exposure to chlorine, the specimens were placed in fresh, inhibitor-free, chlorine-free water. The corrosion rate was then determined to measure the decrease in corrosion rate, i.e., what is generally referred to as the recovery corrosion rate.
4. The above Steps 2 and 3 were repeated in 24 hour cycles for a total of four cycles, with one additional cycle following the weekend period.
5. At the end of a seven day period, the weight loss of the heated tube was determined.

The composition of the water used in these tests is given in Table VIII.

The results of inhibitor evaluations are given in Table IX. This table shows that a mixture of 3 mg/L of HBT and 3 mg/L of TT is superior to either 5 mg/L of TT alone or 10 mg/L of HBT alone. In fact, 5 mg/L of HBT alone failed to provide inhibition of the Admiralty specimen, which indicates insufficient activity to passivate Admiralty under these conditions.

Example 7

Dodecylbenzotriazole (DBT) and TT

The following example shows the use of a mixture comprising TT and dodecylbenzotriazole, sodium salt, (DBT) compared to the individual components.

In this test, copper specimens were immersed in water of specified composition containing the designated concentration of inhibitor at pH 7.5, 50° with aeration. Two waters were used to test the effect of total dissolved solids on passivation effectiveness: the first water was the water described in Table VIII (high TDS), and the other was the water of Example 1 (very high TDS). Corrosion rates were determined by linear polarization at various times to determine the rate of passivation. After 24 hours, the specimens were transferred to inhibitor-free water of a highly corrosive nature (i.e., the water of Example 1) to determine the inhibitor persistency by measuring the corrosion rate each day.

The results are shown in Table X. While 10 mg/L of DBT only slowly and incompletely passivated the copper specimens in the test waters, the mixture of 3 mg/L DBT and 3 mg/L TT gave fast passivation, and persistent protection, in inhibitor-free waters. Thus, 10 mg/L of DBT in both the water of Example 1 and the water of Table VIII failed to passivate the specimens, while the 3:3 mixture gave both good passivation and good protection persistency in both waters.

TABLE VIII

| Composition of BIW Water Used in Example 7 (HBT) | |
|---|---|
| Ion | Concentration (mg/L) |
| Ca | 260 |
| Hg | 115 |
| Cl | 476 |
| $SO_4$ | 460 |
| $SiO_2$ | 9 |
| **Salts Used for Preparation** | **g/200 L** |
| $CaCl_2.2H_2O$ | 194.0 |
| $MgSO_4.7H_2O$ | 236.7 |
| $Na_2SiO_2.9H_2O$ | 8.70 |
| 1N $H_2SO_4$ | 60 mL |
| $NaHCO_3$ (for pH 7.5) | 24.2 |

TABLE IX

Corrosion Rates

Test Conditions: Passivation in test water at 50° C. pH 7.5, 24 hours, containing specified concentration of inhibitor(s). Then transferred to inhibitor-free water, same conditions, followed by addition of 1 mg/L $CL_2$. After 1 hour, transferred to fresh water, inhibitor-free and chlorine-free. Cycle repeated for total of five chlorinations, one of which lasted over a weekend.

| Inhibitor | Passivation Concentration (mg/L) | Corrosion Rate Heated Admiralty Brass Tube Via Weight Loss Method (mpy) |
|---|---|---|
| 1. TT | 5 | 2.1 |
| 2. HBT | 5 | 2.1 |
| 3. HBT | 10 | 0.5 |
| 4. Mixture of HBT and TT | 3 | 0.2 |
| 5. Blank | 0 | 3.5 |

TABLE X

Copper Corrosion Rates in the Presence of DBT Alone and In the Presence of a Mixture of DBT and TT

| | Linear Polarization Corrosion Rate (mpy) | | | |
|---|---|---|---|---|
| Time | 10 mg/L DBT | 3:3 DBT/TT | 10 mg/L DBT | 3:3 DBT/TT |
| Passivation | In BIW Water(Table VIII) | | In Water of Example 1 | |
| 2 Hr. | 0.8 | 0.05 | 5.6 | 0.15 |
| 6 Hr. | 0.6 | 0.03 | 4.5 | 0.10 |
| 2 D. | — | 0.02 | — | 0.06 |
| 3 D. | 0.4 | — | 2.8 | — |
| Persistency (Change to Inhibitor Free Water of Example 1) | | | | |
| 3 D. | 1.4 | 0.06 | 3.0 | 0.06 |
| 6 D. | 1.3 | 0.08 | 3.5 | 0.08 |
| 14 D. | 1.1 | 0.14 | 3.3 | 0.18 |

Conditions: Pretreat in test water, as indicated, containing 10 mg/L DBT alone or a mixture of 3 mg/L DBT and 3 mg/L TT at pH 7.5, 50° C. Then transfer to test water at pH 7.5, 50° C., inhibitor-free for persistency testing.

What is claimed is:

1. A method for inhibiting corrosion in an aqueous system comprising adding to said system an effective amount of a composition comprising: a) a compound having the following formula:

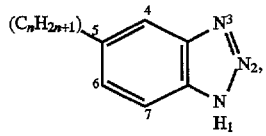

or a salt thereof wherein n is greater than or equal to 3 and less than or equal to 12; and b) a compound selected from the group consisting of tolyltriazole, benzotriazole, mercaptobenzothiazole, 1-phenyl-5-mercaptotetrazole, isomers of 1-phenyl-5-mercaptotetrazole, substituted phenyl mercaptotetrazole and salts thereof wherein the weight ratio of a):b) ranges from about 0.01:100 to about 100:1.

2. The method of claim 1, wherein said aqueous system is in contact with a copper-containing metallic surface.

3. The method of claim 1, wherein at least about 0.1 ppm of said composition is added to said aqueous system, based on the total weight of the water in said aqueous system.

4. The method of claim 1, wherein said compound (b) is tolyltriazole or a salt thereof.

5. The method of claim 1, wherein said system contains high dissolved solids.

6. The method of claim 1, wherein said system contains chlorine.

7. The method of claim 1, wherein a) is butylbenzotriazole, or a salt thereof.

8. The method of claim 6, wherein said aqueous system is in contact with a copper-containing metallic surface.

9. The method of claim 3, wherein a) is butylbenzotriazole or a salt thereof.

10. The method of claim 7, wherein said aqueous system is in contact with a copper containing metallic surface.

11. The method of claim 8, wherein said system contains high dissolved solids.

12. The method of claim 10, wherein said system contains high dissolved solids.

13. The method of claim 8, wherein said system contains chlorine.

14. A composition comprising:

a) a compound having the following formula:

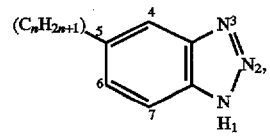

or a salt thereof, wherein n is greater than or equal to 3 and less than or equal to 12; and b) a compound selected from the group consisting of tolyltriazole, benzotriazole, mercaptobenzotriazole, 1-phenyl-5-mercaptotetrazole isomers of 1-phenyl-5-mercaptotetrazole, substituted phenyl mercaptotetrazoles and salts thereof, wherein the weight ratio of a):b) ranges from about 0.01:100 to about 100:1.

15. An aqueous system comprising: a) a compound having the following formula:

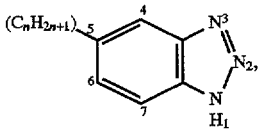

or a salt thereof, wherein n is greater than or equal to 3 and less than or equal to 12; and b) a compound selected from the group consisting of tolyltriazole, benzotriazole, mercaptobenzotriazole, 1-phenyl-5-mercaptotetrazole and salts thereof, wherein the weight ratio of a):b) ranges from about 0.01:100 to about 100:1 and c) water.

16. A composition comprising a copper corrosion inhibitor selected from the group consisting of tolyltriazole, benzotriazole, mercaptobenzothiazole, 1-phenyl-5-mercaptotetrazole, isomers of 1-phenyl-5-mercaptotetrazole, substituted phenyl mercaptotetrazoles, and salts thereof and an effective amount for the purpose of improving the effectiveness of said copper corrosion inhibitor of a $C_3$ to $C_{12}$ alkylbenzotriazole or salt thereof.

17. The composition of claim 16, wherein said alkyl benzotriazole is butyl benzotriazole.

18. The composition of claim 17, wherein said copper corrosion inhibitor is selected from the group consisting of tolyltriazole and salts thereof, and wherein said composition contains at least about 0.001 part butyl benzotriazole per part alkyl benzotriazole.

* * * * *